US005343578A

United States Patent [19]

Kettenhofen

[11] Patent Number: 5,343,578

[45] Date of Patent: Sep. 6, 1994

[54] HINGE-ZIPPER MULTI-ENTRY SLEEPING BAG

[75] Inventor: Robert Kettenhofen, Fallbrook, Calif.

[73] Assignee: Summersea International, Inc., Fallbrook, Calif.

[21] Appl. No.: 82,780

[22] Filed: Jun. 28, 1993

[51] Int. Cl.[5] ..... A47C 29/00

[52] U.S. Cl. ..... 5/413; 2/69.5

[58] Field of Search ..... 5/413, 417, 420; 2/69, 2/69.2

[56] References Cited

U.S. PATENT DOCUMENTS

| | | | |
|---|---|---|---|
| 917,403 | 4/1909 | Benger | 5/413 |
| 2,064,458 | 12/1936 | Bulpit | 5/413 |
| 2,594,438 | 4/1952 | Howe | 5/413 |
| 3,584,323 | 6/1971 | Worley | 2/69.5 |
| 4,513,461 | 4/1985 | Tardivel | 2/69.5 |
| 5,005,235 | 4/1991 | Huang | 5/413 |

*Primary Examiner*—Flemming Saether
*Attorney, Agent, or Firm*—Stuart W. Knight

[57] ABSTRACT

A multi-layered and multi-entry sleeping bag is provided which comprises several separate generally rectangular leaves or layers permanently affixed to each other by hinge means. Attached to such leaves are zipper means whereunder portions of such leaves can be removably attached to one another by such zipper means. In such fashion, multi-layered or multi-entry portions of the layers or leaves can be provided. The number of layers can be adjusted depending upon the camper's desire or warmth. The zippers can be unlocked, in which case the blanket can be fully unfolded.

1 Claim, 2 Drawing Sheets

HINGE-ZIPPER MULTI-ENTRY SLEEPING BAG

The Invention relates to sleeping bags and in particular to a novel design for construction of a multi-entry and multi-layer sleeping bag.

Various sleeping bags have been designed for use in camping whereunder various layers have been designed to provide mulitiple sleeping compartments so that the user can conveniently select one or more layers depending upon climatic conditions. For example, during cold sleeping conditions, the user may desire two or three more layers of material above him or her, whereas, during warmer conditions, the user may desire only one or two layers above him or her. Various designs have been shown in prior art patents, including but not limited to U.S. Pat. No. 3,584,323 to Worley; U.S. Pat. No. 2,594,438 to Howe; U.S. Pat. No. 3,508,285 to Marquette; U.S. Pat. No. 5/146,634 to Hunt; U.S. Pat. No. 4,513,461 to Tardivel.

Various multi-layer sleeping bags are shown in such patents.

Applicant has, however, made a novel sleeping bag design, which utilizes a unique technique comprising a "hinge and zipper combination" for a multi-layer sleeping bag which can be conveniently utilized by the camper.

In applicant's device, the novel hinge and zipper combination results in a more convenient and easily utilized method for adjusting the multi-layers or in utilizing the device for a simple sleeping blanket.

Accordingly, one object of the invention is to provide a multi-entry or multi-layer sleeping bag. Another object of the invention is to provide a more convenient and easily utilized hinge and zipper sleeping bag. Other objects of the invention will be apparent from the following description.

SUMMARY OF THE INVENTION

The Invention comprises several similar or dissimilar layers of generally rectangular sleeping bag material which are sewn together to form a series of hinges. In the event that there are four layers, three hinges are made to bind the four layers. The ends of the rectangular layers not hinged are then fitted with a zipper whereunder such portions can be movably attached to other portions of other rectangular layers. Thus, the camper can utilize different layers depending upon his or her desires for warmth. Also, the zippers can be undone utilized so that the entire series of layers can be opened up and utilized as a picnic blanket.

THE DRAWINGS

DETAILED DESCRIPTION OF THE INVENTION

Figure 1:
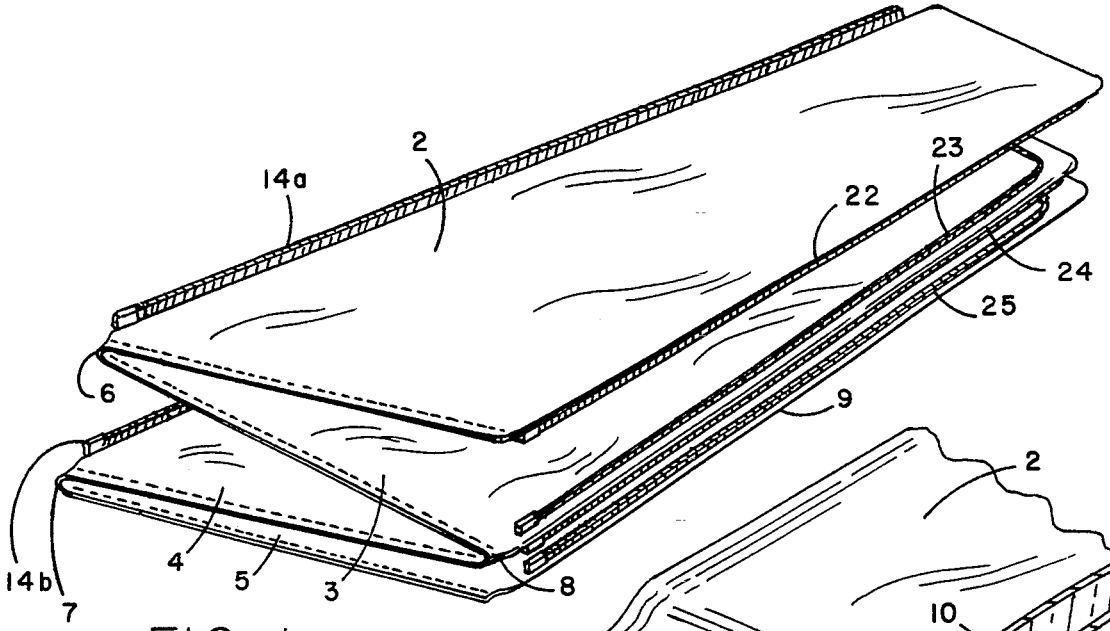
FIG. 1 shows a perspective view of the Invention, showing the four layers opened in a non-zippered position.

Referring to FIG. 1, there is shown four separate "leaves" or layers 2, 3, 4, and 5. Leaf 2 is shown attached to leaf 3 by "hinge" 6. Such leaves or layers can be attached by simply sewing one another to each other to form the "hinge". Other attachment means can be utilized to form a permanent attachment. The term "hinge" is utilized herein in that the layers rotate about the permanently affixed area attaching the two leaves or layers.

Likewise, leaf 4 is permanently attached to leave 5 utilizing hinge 7.

There is shown a zipper **14*a* attached to leaf or layer 2 in close proximity to hinge 6. Likewise, there is shown a zipper 14*b* attached to leaf 4 in close proximity to hinge 7. As will be later described, zipper 14*a* and zipper 14*b* can be removably attached where one desires to utilize leaves 2 and 3, i.e., insert themselves into a sleeping blanket comprised of leaves 2 and 3**.

Also shown in FIG. 1 are zippers 22, 23, 24 and 25 attached to leaves 2, 3, 4, and 5, respectively on the sides opposite to zipper 14 and **14*b*, also located on one end of said leaves. Such zippers can be utilized to enclose or removably attach leaf 2 with leaf 3, and also leaf 4 with leaf 5, so that the camper can be contained within such spaces. For example, zipper 22 can be united with zipper 23. The camper can insert himself or herself between layers 2 and 3. Similarly, zipper 24 can be united with zipper 25 so that the camper can insert himself or herself within the space defined by leaves 4 and 5. In such position, there are leaves 2, 3, and 4 above the camper and leaf 5** below the camper.

Also, the camper can unite zipper 22 with zipper 23; insert himself within the space defined by leaf 3 and leaf 4; and thereafter unite zipper **14*a* with zipper 14*b*. In such a position, leaves 2 and 3 will be above the camper. Also, the camper can unite zipper 23 and 22, insert himself between layer 4 and 5, and thereafter unite zipper 24 and 25. Thus, the camper can utilize several combinations as shown in FIG. 1**. Such a system provides for versatility of the leaves or warmth layers for the camper's convenience and desired warmth.

Figure 2:
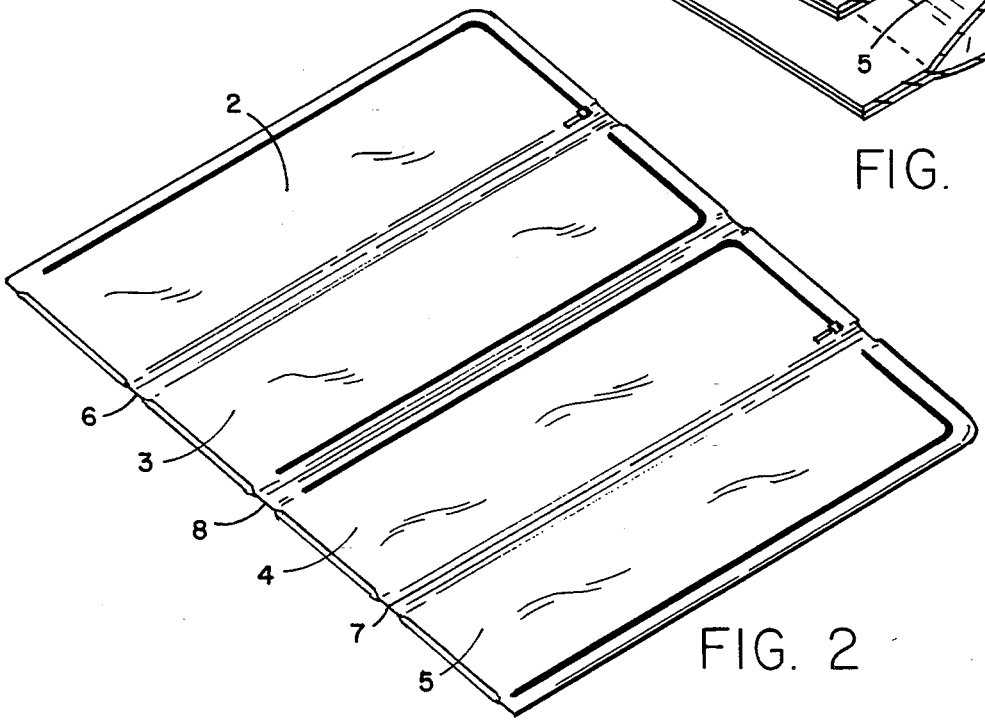
FIG. 2 shows four layers completely opened in a "non-zipper" position.

FIG. 2 Shows the four leaves extended flat on the ground. There is shown blanket leaves 2, 3, 4 and 5 in a flat position each connected by hinges 6, 8, and 7 as shown. Hinge 6 connects leaves 2 and 3. Hinge 8 attaches leaves 3 and 4. Hinge 7 attaches leaf 4 with leaf 5. There is shown the several zippers previously described. Thus, the multi-layered sleeping bag of the invention can be fully opened.

Figure 3:
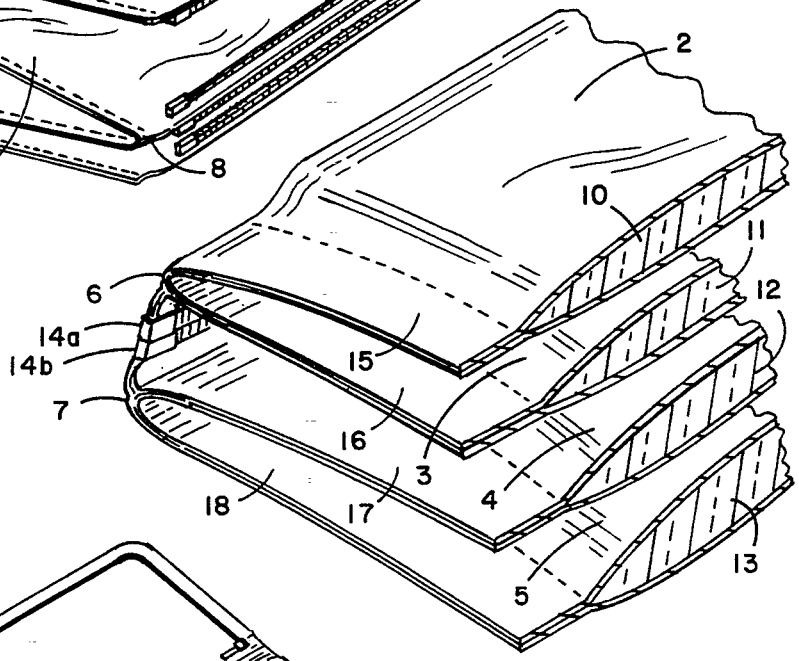
FIG. 3 shows an end view of the Invention showing two layers zippered to two other layers.

FIG. 3 shows an embodiment of the invention whereunder hinge 6 is connected to hinge 7 by way of zippers **14*a* and 14*b*. As previously described, a zipper 14*a* is attached to leaf 2 in close proximity to hinge 6. Zipper 14*b* is attached to hinge 7 in close proximity to leaf 4. It may be desired by the camper to utilize the space between leaves 2 and 3. In such a case, the camper would connect hinge 6 with hinge 7. The camper would unite zippers 23 and 22 after the camper is contained within the space between leaves 3 and 4. Also shown in FIG. 3 are fillings to the multi-layer blankets, i.e., fillings 10, 11, 12 and 13. As in all prior art camping bags, there is an outer layer which may be composed of water-repellant material and the like, and an inner filling for insulation purposes. Also depicted in FIG. 3 are outer end portions of each leaf or layer 15, 16, 17, 18**, as is known in the prior art.

Figure 4:
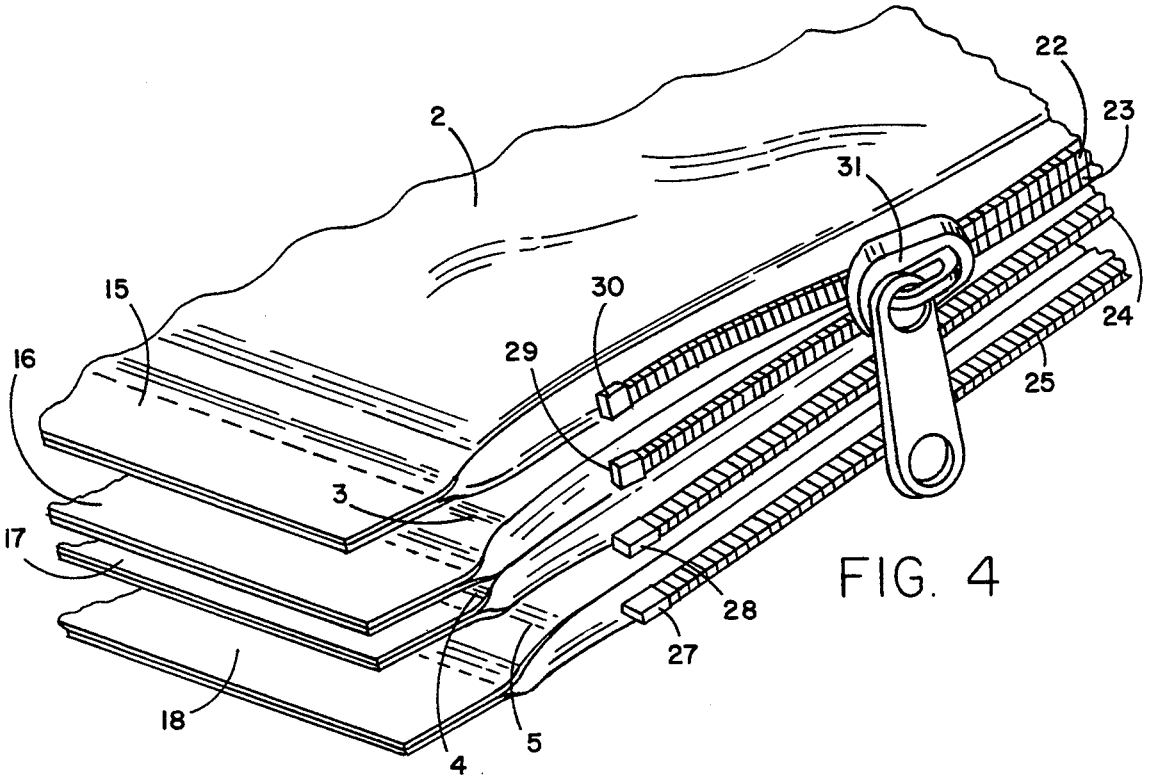
FIG. 4 shows another end view of the Invention showing two layers zipped to one another and another two layers not zipped to one another.

FIG. 4 shows a side view of the invention. There is shown zipper tab 31 utilized to unite zipper 22 with zipper 23. Also shown is zipper 24 which can be utilized with zipper 25 by a zipper tab not shown. In such fashion, leaf 2 can be removably attached or made in close proximity with leaf 3 by attaching zipper 22 with zipper 23. Similarly, leaf 3 can be made in close proximity with leaf 4 by uniting zipper 24 with zipper 25. Also shown in FIG. 4 are zipper terminals 27, 28, 29 and 30.

In the embodiment shown herein, there are four blanket leaves, each having fillings and upper and lower outer skins or layers. There can be embodiments containing a greater number of leaves by simply hinging more leaves. For example, another leaf can be permanently attached to leaf 2 by hinge means attached adjacent to the portion of leaf 2 adjacent to zipper 22.

Accordingly, the embodiment shown herein is simply for illustration and should not be limited to a sleeping blanket containing only four leaves or layers of blanket.

I claim:

1. A multi-entry and multi-layered sleeping blanket comprising: (a) four or more generally rectangular blanket layers;

(b) a first hinge means connecting a first layer of said layers to a second layer of said layers;

(c) a second hinge means connecting said second layer to a third layer of said layers with said second hinge means being on a side of said second layer opposite from the side of said second layer which is attached to said first hinge means;

(d) a third hinge means connecting said third layer to a fourth layer of said layers with said third hinge means being on a side of said third layer opposite from the side of said third layer which is attached to said second hinge means: and (e) zipper means attached to each of said layers sufficient to removably attach said first layer to said second layer: to removably attach said second layer to said third layer; and sufficient to removably attach said third layer to said fourth layer.

* * * * *